United States Patent [19]

Germann

[11] Patent Number: 4,479,431

[45] Date of Patent: Oct. 30, 1984

[54] COLLECT-PRINTING UNIT FOR SECURITY PRINTING FOR USE IN A ROTARY PRINTING PRESS

[75] Inventor: Albrecht J. Germann, Würzburg, Fed. Rep. of Germany

[73] Assignee: Koenig & Bauer Aktiengesellschaft, Würzburg, Fed. Rep. of Germany

[21] Appl. No.: 355,396

[22] Filed: Mar. 8, 1982

[30] Foreign Application Priority Data

Apr. 1, 1981 [DE] Fed. Rep. of Germany ..... 3113055

[51] Int. Cl.[3] ..... B41F 7/08; B41L 17/12

[52] U.S. Cl. ..... 101/136; 101/175; 101/349; 101/141

[58] Field of Search ..... 101/175, 176, 177, 135, 101/136, 137, 211, 348, 349; 283/57, 58, 59

[56] References Cited

U.S. PATENT DOCUMENTS

| | | | |
|---|---|---|---|
| 1,052,473 | 2/1913 | Firm | 101/175 X |
| 1,883,227 | 10/1932 | Wood | 101/176 |
| 3,390,631 | 7/1968 | Koszul | 101/155 |
| 3,426,679 | 2/1969 | Rhines | 101/175 |
| 3,448,686 | 6/1969 | Bohman | 101/348 |
| 4,056,056 | 11/1977 | Giori | 101/177 |

FOREIGN PATENT DOCUMENTS

| | | | |
|---|---|---|---|
| 489839 | 8/1938 | United Kingdom | 101/211 |
| 803546 | 10/1958 | United Kingdom | 101/175 |

*Primary Examiner*—Edgar S. Burr
*Assistant Examiner*—David A. Wiecking
*Attorney, Agent, or Firm*—Jones, Tullar & Cooper

[57] ABSTRACT

A collect-printing unit for security printing in offset printing for use in a rotary printing press, provided with a blanket cylinder to which a plurality of cut-out offset rollers are coordinated, is disclosed. Two ink transfer cylinders and one forme cylinder, on whose periphery a plurality of offset printing formes are fixed, are coordinated to this blanket cylinder. Another blanket cylinder is coordinated to the forme cylinder, this blanket cylinder taking the multi-color motif to be printed from the forme cylinder and transferring it onto the support to be printed. A counter pressure cylinder may cooperate with this blanket cylinder. A sheet-shaped or web-shaped support to be printed is interposed between the blanket cylinder and the counter pressure cylinder and is printed in offset collect-printing.

10 Claims, 1 Drawing Figure

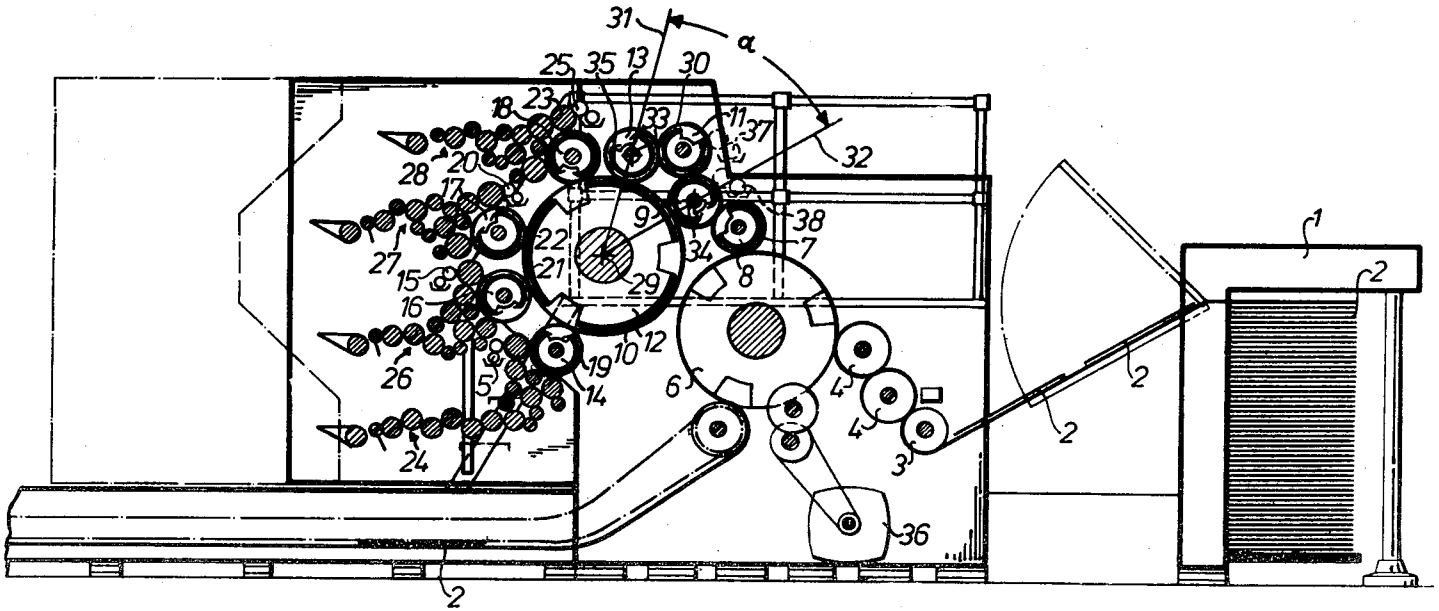
1
2
2
2
3
4
4
4
36
6
12
10
19
14
29
9
22
21
5
8
7
38
34
8
37
11
32
α
30
33
13
31
35
25
23
18
20
17
28
27
15
16
26
24
2

COLLECT-PRINTING UNIT FOR SECURITY PRINTING FOR USE IN A ROTARY PRINTING PRESS

FIELD OF THE INVENTION

The present invention is directed generally to a collect-printing unit for security printing in offset printing for use in a rotary printing press. More particularly, the present invention is directed to a collect-printing unit having a plurality of offset inking units coordinated to one blanket cylinder. Most specifically, the present invention is directed to a collect-printing unit for printing multi-color safety backgrounds on security paper. A plurality of offset inking units are positioned about the periphery of a blanket cylinder. Each inking unit transfers ink to a blanket on the blanket cylinder. After multiple inks have been transferred to each such blanket, the multi-color ink array is moved by transfer rollers to an offset printing plate carried on a forme cylinder. The multi-color ink image formed on the offset printing plate is then transferred to a blanket on a cooperating blanket cylinder and thence to a support such as a sheet which is being printed.

DESCRIPTION OF THE PRIOR ART

Collect-printing rotary printing presses for dry offset printing are known generally in the art. In these prior art machines, a plurality of forme cylinders which each carry letterpress printing plates are disposed around a blanket cylinder. Each forme cylinder has an inking unit associated with it so that each letterpress printing plate transfers a one ink color portion of a multi-color ink image to be formed to the blanket cylinder. Through the cooperation of a plurality of these individual letterpress printing plates, a multi-color ink image is gradually formed on the blanket cylinder and is then transferred to the support being printed.

Elastic cut-out rollers are used to transfer the various inks from the ink units to the letterpress printing plates. Such elastic cut-out rollers are known generally in the art, as may be seen in U.S. Pat. No. 3,390,631.

SUMMARY OF THE INVENTION

It is an object of the present invention to provide a collect-printing unit for security printing in offset printing for use in rotary printing presses.

Another object of the present invention is to provide a collect-printing unit for printing multi-color lines forming a safety background on security paper.

A further object of the present invention is to provide a collect-printing unit for offset printing lines with continuous color change free from register displacement.

Yet another object of the present invention is to provide a collect-printing unit which uses offset printing plates to produce a clear, sharp image.

As will be discussed in greater detail in the description of the preferred embodiment, a blanket cylinder which may have several blankets about its periphery receivers a plurality of inks from offset inking units through sectorially cut-out rollers. The multi-ink array collected on the blanket cylinder is transferred by two transfer cylinders to an offset printing plate or forme that is secured on the periphery of a forme cylinder. The offset printing plate forms a multi-ink image which is then transferred by another blanket cylinder to the support such as a sheet to be printed.

An advantage of the present invention is that lines or areas can be printed in continuous color change in offset printing without any register displacement. There is no necessity of providing an ink collecting cylinder for each color ink which then transfers each ink color to a hard letterpress printing forme. There is also no necessity of providing a plurality of forme cylinders which each print one color of a multi-color background of security lines. The time consuming and difficult registering of the individual letterpress printing formes to each other, as was necessary in the prior art devices, is no longer required.

It is possible to utilize offset printing plates in the present invention and to thereby obtain a high quality printed image. The width of lines on the printing forme is maintained while the lines are being transferred to the support being printed. The external contours of the lines and printed areas are sharply marked off and present a uniform ink coverage. There are furthermore, no squeezed margins or inexact ink coverages which can occur in indirect letterpress printing from a hard forme onto a support to be printed.

Hard offset ink contour plates can be sectorially inked by means of sectorially cut-out rollers having cooperating cut-out portions. The hard offset plates are durable and have a long life and are quite easily produced. The production of the smooth rubber ink contour plates as has been required prior to the subject invention has been very expensive and not wholly satisfactory since these prior plates do not assure exact registry. The use of offset ink contour plates also permits the inking of small color areas in a field of another color since, in contract to the prior rubber ink contour plates, the hard offset ink contour plates of the present invention do not shift when meeting with the hard printing forme. Such shifting does occur when rubber ink contour plates are used.

Thus, the collect-printing unit for security printing in accordance with the present invention utilizes offset printing plates and inking units to print multi-color lines and areas as safety backgrounds on security papers with a much higher degree of precision than has been possible with prior art devices.

BRIEF DESCRIPTION OF THE DRAWING

While the novel features of the collect-printing unit for security printing in offset printing for use in a rotary printing press in accordance with the present invention are set forth with particularity in the appended claims, a full and complete understanding of the invention may be had by referring to the description of a preferred embodiment as set forth hereinafter and as may be seen in the accompanying drawing, which is:

a schematic side view of a collect-printing rotary printing press with a printing unit in accordance with the present invention.

DESCRIPTION OF THE PREFERRED EMBODIMENT

Turning now to the sole drawing FIGURE, there may be seen a preferred embodiment of the collect-printing unit in accordance with the present invention. While the invention will be described hereinafter with reference to a sheet-fed rotary printing press, it will be understood that the printing unit of the present invention could also be used with a web-fed rotary printing press.

In the preferred embodiment, supports to be printed such as sheets 2, arrive from a sheet feeder 1 in a known manner such as by means of conveyor tapes (not shown) over a stop drum 3, and transfer drum 4 onto a counter pressure cylinder 6. The stop drum 3, transfer drums 4, and counter pressure cylinder 6 are provided in a sheet-fed rotary printing press with controlled sheet grippers which are known in the art. The counter pressure cylinder 6 does not carry a rubber blanket around its periphery, and is therefore a hard counter pressure cylinder.

A first small blanket cylinder 8 cooperates under pressure with the counter pressure cylinder 6. The support to be printed, for example sheet 2, is printed by being interposed between the counter pressure cylinder 6 and the first blanket cylinder 8. The first blanket cylinder 8 carries a blanket 7 around its periphery. This blanket 7 is inked, for example, sectorially in different colors, by an offset printing forme fixed on a forme cylinder 9. The forme cylinder 9 carries a hard, wet-offset printing forme around its periphery, which corresponds to the motif to be printed. This offset printing forme, or a plurality of such formes which are fixed on the forme cylinder 9, are sectorially inked in different colors by a sectorial ink coating on a blanket 30 fixed on a first ink transfer cylinder 11. The blanket 30 of the first ink transfer cylinder 11 receives its sectorial, multicolor ink coating from a blanket 35 of a second ink transfer cylinder 13. This blanket 35 receives its ink coating from a blanket 10 of a second large blanket cylinder 12. The blanket 10 of the second blanket cylinder 12 is inked by offset ink contour plates 19, 21, 22, and 23, which are fixed on cut-out rollers 14, 16, 17, and 18.

The plurality of cut-out rollers 14, 16, 17, and 18 are spaced, for example, about half the circumference of the second blanket cylinder 12. One of the offset ink contour plates, or cut-out plates 19, 21, 22, 23 is disposed on the periphery of each cut-out rollers. Each of the offset ink contour plates 19, 21, 22, 23 which have ink-absorbing areas extending essentially in sectors, is inked by an inking unit 24, 26, 27, 28 which is coordinated to it. A damping unit 5, 15, 20, 25, which is known in the art, is coordinated to each one of the inking units 24, 26, 27, 28.

The cut-out rollers 14, 16, 17, and 18 all have peripheries of the same lengths or diameters as the second ink transfer cylinder 13, the first ink transfer cylinder 11, the forme cylinder 9, and the first blanket cylinder 8. The diameter of the second blanket cylinder 12 is a multiple of the diameter of each of the cylinders and rollers just mentioned, such as triple the diameter, as is shown in the preferred embodiment. The counter pressure cylinder 6 can have the same diameter as the second blanket cylinder 12; it can, alternatively have the same diameter as the first blanket cylinder 8.

If the second blanket cylinder 12 has triple the diameter of the second ink transfer cylinder 13, or the first ink transfer cylinder 11, and the forme cylinder 9, an angle $\alpha$ is formed between straight lines 31 and 32 which intersect in the center of rotation 29 of the second blanket cylinder 12. This angle is 42.94°. In this case, the axis of rotation 33 of the second ink transfer cylinder 13 lies on straight line 31, and the axis of rotation 34 of the forme cylinder 9 lies on straight line 32. This results, in accordance with the invention, in a multiple inking or ink splitting of the offset printing forme fixed on the forme cylinder 9, in the preferred embodiment a double inking, which is staggered by the length of a forme cylinder periphery, that is in percise register.

In accordance with the present invention, due regard is paid to the necessity, if other ratios between the cylinder and roller diameters are preferred, that the offset ink coating on the blanket 10 of the second blanket cylinder 12 is split at least twice, before the ink coating is transferred onto the support to be printed.

A sectorial ink coating is produced in accordance with the present invention on the second blanket cylinder 12 by the offset ink contour plates 19, 21, 22, and 23. This sectorial ink coating is transmitted onto the blanket 35 of the second ink transfer cylinder 13, and from this blanket 35 onto the blanket 30 of the first ink transfer cylinder 11. The blanket 30 transfers the sectorial ink coating onto the printing forme on the forme cylinder 9. Additionally, the printing forme on the forme cylinder is inked by contact with the sectorial ink coating on the blanket 10 of the second blanket cylinder 12. The first ink transfer cylinder 11 and the forme cylinder 9 may be provided with conventional damping units 37 and 38 respectively, as shown in dashed lines in the sole drawing FIGURE.

All the cylinders, drums and rollers are synchronously driven in a manner known in the art by a main motor 36 through a common gear drive train.

It will be understood that although not shown in the drawing, the printing unit in accordance with the present invention can also be utilized for simultaneous recto and verso printing. In this case the counter pressure cylinder 6 is not utilized and a third blanket cylinder 8 is placed in mirror image disposition to the first blanket cylinder 8.

In addition, a second forme cylinder 9, a third ink transfer cylinder 11, a fourth ink transfer cylinder 13, and a fourth blanket cylinder 12, which is inked by a plurality of second cut-out rollers 14, 16, 17, and 18 having offset ink contour plates 19, 21, 22, 23, with each inking unit 24, 26, 27, 28 having a damping unit 5, 15, 20, 25 being coordinated to each of the second cut-out rollers 14, 16, 17, 18 are provided. These various cylinders and rollers are placed as the mirror image of the printing unit shown in the drawing to allow the simultaneous recto and verso printing.

It would also be possible to dispose a printing unit for dry offset printing (indirect letterpress printing) comprising a counter pressure cylinder, as described in the U.S. patent application No. 355,393. Instead of the mirror image printing unit described above to accomplish recto and verso printing.

The printed sheets 2 are conveyed to a sheet delivery by means of gripper systems known in the art, where they are laid down on a pile. If the printing unit in accordance with the present invention is utilized in a web-fed rotary printing press, the printed paper web is conveyed, for example, to a sheeter, which cuts the web to sheets and transfers these to a pile delivery.

Collect-printing units for security printing which are generally similar to the subject invention are set forth in applicant's German Patent Application Nos. P3109964.5, and P3109963.7, filed in Germany on Mar. 14, 1981; P3113407.6, filed in Germany on Apr. 3, 1981; and German Patent Application No. P3109977.7 of Germann and Ruckmann filed in Germany on Mar. 14, 1981; and their corresponding United States patent applications Ser. Nos. 355,392, 355,393, 355,394, and 355,395, respectively filed on even date with the subject application and assigned to a common assignee.

While a preferred embodiment of a collect-printing unit in accordance with the present invention has been set forth fully and completely hereinabove, it will be obvious to one of skill in the art that a number of changes in, for example, the numbers of inking units, blankets on the blanket cylinders, and transfer cylinders; the specific drive means; the use of either webs or sheets as the supports to be printed; and the like could be made without departing from the true spirit and scope of the invention, and that the invention is to be limited only by the following claims.

I claim:

1. A collect-printing unit for security printing a complete multi-color ink coating on a support to be printed in offset printing for use in a rotary printing press, said collect-printing unit comprising:

a first forme cylinder carrying at least one offset printing forme on its periphery;

a first blanket cylinder contacting said forme cylinder and receiving the complete multi-color image to be printed on the support from said forme cylinder;

a second blanket cylinder contacting said forme cylinder and having a plurality of ink receiving blankets affixed to the periphery of said second blanket cylinder;

a counter pressure cylinder contacting said first blanket cylinder, the support to be printed being interposed between said counter pressure cylinder and said first blanket cylinder;

a plurality of first cut-out rollers, each of said cut-out rollers carrying an offset ink contour plate, each of said offset ink contour plates receiving one color of said multi-color ink coating, each of said cut-out rollers further having an inking unit coordinated thereto to supply said one color of said multi-color ink coating to said offset ink contour plate affixed thereto, each of said plurality of cut-out rollers being in contact with each of said ink receiving blankets on said second blanket cylinder to impart said complete multi-color ink coating to each of said ink receiving blankets on said second blanket cylinder; and, a first ink transfer cylinder contacting said forme cylinder, and a second ink transfer cylinder contacting both said first ink transfer cylinder and said second blanket cylinder, said forme cylinder receiving a double inking formed as a combination of partial ones of said complete multi-color ink coatings that are imparted to successive ones of said ink receiving blankets on said second blanket cylinder, said partial coatings being transferred in registry to said forme cylinder from both said first ink transfer cylinder and said second blanket cylinder, said forme cylinder transferring said complete multi-color ink coating to said first blanket cylinder.

2. The collect-printing unit for use in a rotary printing press in accordance with claim 1, wherein a damping unit is coordinated to each of said cut-out rollers.

3. The collect-printing unit for use in a rotary printing press in accordance with claim 1, wherein a damping unit is coordinated to said first ink transfer cylinder.

4. The collect-printing unit for use in a rotary printing press in accordance with claim 1, wherein a damping unit is coordinated to said first forme cylinder.

5. The collect-printing unit for use in a rotary printing press in accordance with claim 1, wherein the peripheries of said cut-out rollers, of said first ink transfer cylinder, of said second ink transfer cylinder, of said forme cylinder, and of said first blanket cylinder are of equal lengths, further wherein the periphery of said second blanket cylinder is an integral multiple of said forme cylinder periphery, and further wherein said counter pressure cylinder has the same periphery as said second blanket cylinder.

6. The collect-printing unit for use in a rotary printing press in accordance with claim 1, wherein the periphery of said second blanket cylinder compared with the peripheries of said cut-out rollers, said second ink transfer cylinder, and said first blanket cylinder has a ratio of 3:1.

7. The collect-printing unit for use in a rotary printing press in accordance with claim 1, wherein said cut-out rollers carry offset ink contour plates which are capable of being sectorially inked.

8. The collect-printing unit for use in a rotary printing press in accordance with claim 1, wherein said counter pressure cylinder is a hard cylinder.

9. The collect-printing unit for use in a rotary printing press in accordance with claim 1, wherein a third blanket cylinder is placed in contact with said first blanket cylinder.

10. The collect-printing unit for use in a rotary printing press in accordance with claim 6 further wherein said second ink transfer cylinder and said forme cylinder are disposed at an angle $\alpha$ of 42.94°, said angle $\alpha$ being defined as the angle between first and second lines which extend radially outwardly from the axis of rotation of said second blanket cylinder, said first line passing through the axis of rotation of said forme cylinder and said second line passing through the axis of rotation of said second ink transfer cylinder.

* * * * *